United States Patent [19]

Eder

[11] 4,013,221

[45] Mar. 22, 1977

[54] PRESSURE BALANCING DEVICE FOR HEATING SYSTEMS

[76] Inventor: Anton Eder, Haus No. 68, 5733 Brambert,Pinzgau, Austria

[22] Filed: Apr. 17, 1975

[21] Appl. No.: 569,070

[30] Foreign Application Priority Data

Apr. 17, 1974 Austria ..... 3185/74

[52] U.S. Cl. ..... 237/8 R; 138/30; 237/66

[51] Int. Cl.[2] ..... F16L 55/04; F24H 9/20

[58] Field of Search ..... 138/30; 237/66, 8 R, 237/65; 137/568; 122/35

[56] References Cited

UNITED STATES PATENTS

| | | | |
|---|---|---|---|
| 1,732,505 | 10/1929 | Dawson | 237/66 |
| 3,076,479 | 2/1963 | Ottung | 138/30 |
| 3,559,727 | 2/1971 | Hill | 237/66 |
| 3,807,901 | 4/1974 | Wilson | 138/30 |

*Primary Examiner*—William E. Wayne

*Attorney, Agent, or Firm*—Wenderoth, Lind & Ponack

[57] ABSTRACT

An expansion tank is connected to a heating system by feed and drain pipes whereby the flow of water into and out of expansion tank is regulated by a valve and a pump. In the expansion tank there is a bellow which is in contact with the outer air.

5 Claims, 2 Drawing Figures

PRESSURE BALANCING DEVICE FOR HEATING SYSTEMS

BACKGROUND OF THE INVENTION

The invention relates to a pressure-balancing device for heating systems with an expansion tank which receives the heating medium, which is closed to outside air and which is connected to the heating system by feed and drain pipes, whereby a chamber of variable volume inside the expansion tank is provided.

It is known that the volume of large heating or cooling systems changes with the heating or cooling of the heating medium water. The surplus volume must be taken out of the system in the case of constant pressure, and in the case of cooling and the resulting volume decrease of the water in the system, the water must be returned to the system at the same pressure ratio.

With such heating systems it is known to deliver the water surplus caused by thermal expansion to an open reservoir and to deliver water to the system from exactly this reservoir through a pump in the case of a volume decrease.

It is of disadvantage that the heating liquid comes into contact with the outside air in the open reservoir, since this involves a substantial increase in the danger of corrosion in the system.

A pressure-balancing device is known in which the heating medium water remains separate from the outside air.

This pressure-balancing device essentially consists of a pressure tank and a group of automatic compressors which are directly mounted on the tank in small systems. In bigger systems the parts of the automatic device are placed separately.

A flange is welded to the upper and lower side of the tank whereby a rubber tube clamped between the two flanges is directly connected to the system and receives the water surplus caused by a volume increase in case of a temperature rise.

As to the construction of the tank, there is an air space between the rubber tube and the tank wall, which space is kept under pressure, i.e. under the pressure of the system, by a separate compressor. An adaptable piston manometer with limit switches controls the compressor and opens in the case of excess pressure a solenoid valve so that the pressure can constantly be kept at about $\pm 0.2$ atm (1 atm = 1 kp/cm3 = 17,285 25 tr.lbs/sq in).

The function of the pressure-balancing device is as follows:

If more water of the system is delivered into the tube, air of the space between the tank wall and the tube will be blown out in order to keep a constant pressure. If the heating medium flows out of the tube, the resultant additional space in the ring slot will be filled up by air pumped in by the compressor.

The disadvantage of the known pressure-balancing device is the fact that the tank has the same pressure as the system itself.

According to Austrian regulations the tank requires a test certificate. This fact naturally entails a substantial rise in the price of the device and service therefor.

SUMMARY OF THE INVENTION

It is the object of the invention to provide a pressure-balancing device for heating systems of the above-mentioned kind with, of course, the same function and security, but wherein a pressure-balancing device not requiring a test certificate can be used, i.e. a tank which has to receive only a small fraction of the pressure of the heating system.

According to the invention this is achieved by the fact that a chamber is connected to the outside air and that the changes in volume of the chamber changes are dependent on the low pressure inside the expansion tank.

One embodiment of the invention provides that the chamber is placed in an additional tank which is sealed against the outside and which is connected to the expansion tank by pipes.

According to the invention the chamber is preferably formed by a bellows, whereby the use of simple tubes like those used for cars and lorries has shown optimum results.

The fact that the part used for the bellows, e.g. the tube, may be a mass-production article, which would by no means be available in the case of a unit specially adapted to the pressure-balancing device, causes substantial economic advantages for the system.

According to the invention it is also provided that the chamber is formed by a part of the expansion tank which is separated from the water-receiving part thereof by a diaphragm.

BRIEF DESCRIPTION OF THE DRAWINGS

In the following a detailed description of the invention is given with reference to the attached drawings without being restricted to the embodiments specifically described.

DETAILED DESCRIPTION OF THE INVENTION

Figure 1:
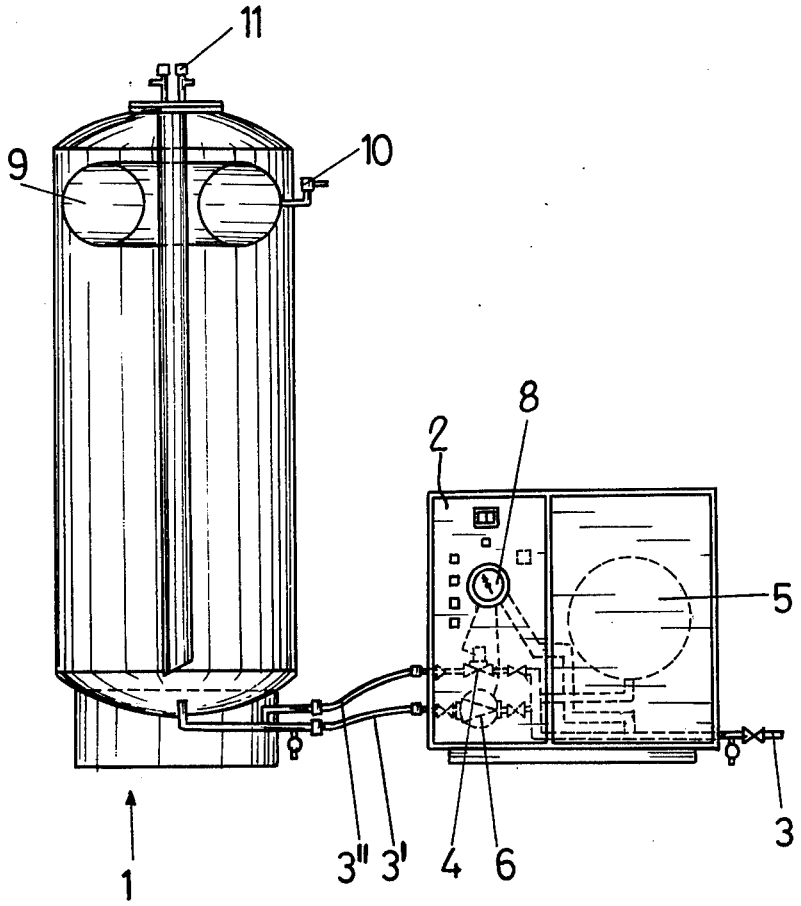
FIG. 1 is a schematic diagram of the pressure-balancing device according to a first embodiment of the invention.

The actual heating system, not being the subject of the invention and belonging to the fundamental knowledge of every expert, is not shown in the drawings. The pressure-balancing device according to the invention can be applied to various heating systems of different kinds.

In the figures of the drawings, 1 is the actual expansion tank, and 2 is a control case in front of the tank which is connected to the actual heating system by a pipe 3.

A water surplus caused by a volume increase in the heating system is delivered to the expansion tank 1 by pipe 3 through a solenoid valve 4 with a surge chamber 5 positioned upstream thereof.

In case of a decrease in pressure or volume in the heating system a corresponding manometer 8 accuates the pump 6 thereby pumping water back into the heating system through a pipe 3. The function of the pressure-balancing device according to the invention is as follows:

The heating system is filled up to its static pressure whereby a possible vaporization pressure must be considered in systems operating at temperatures over 100° C.

By means of a feed and drain cock, water is filled into the expansion tank 1 up to a level representing 20% of the tank volume.

The level of 20% can be indicated by a water gauge.

A contact manometer 8 is adjusted to a rated value, e.g. the static height puls 5 m.

In the case of a system with a temperature of over 100° C the vaporization pressure must also be added, i.e. the rated value would thus be the static height plus 5 m plus the vaporization pressure.

The heating up of the system causes a volume increase of the water. This means at the same time a rise in pressure indicated by the contact manometer 8. In the case of an increase in pressure of about 0.2 atm a contact switch of the manometer 8 closes the circuit for the solenoid valve 4.

Valve 4 opens to let the water surplus flow into the water-receiving tank 1 through a pipe 3''.

The pipe 3'' preferably consists of a flexible hose.

The overflowing of the water causes a pressure decrease in the heating system, the contact switch interrupts the circuit, and the solenoid valve closes again.

The cooling of the heating system causes a pressure decrease as the water volume decreases.

In the case of a pressure decrease of 0.2 atm a further contact switch of the manometer 8 closes the circuit for the pump 6, which delivers necessary water from the expansion tank 1 back into the system. The resultant pressure increase causes an interruption of the circuit of the pump 6 through the contact switch at a given switching value, and thus turns it off.

The surge chamber 5 is provided to reduce the frequency of switching.

In the upper part of the expansion tank 1 of FIG. 1, there is provided a bellows 9 that consists of an accordion type tube. This bellows 9 is connected to the atmosphere by a socket 10.

If water is pumped out of the expansion tank 1 by the pump 6, which causes a vacuum in tank 1, air passes into the bellows, which fills at least partially the volume of the expansion tank dependent on the vacuum therein.

It is of special importance that the air does not come into contact with the heating medium, i.e. the water, itself.

During the building up of the pressure in the expansion tank 1 air is pressed out of the tube or bellows 9, and thus the expansion tank can receive water from the heating system without the necessity of discharging water.

It is provided to mount on the socket 10, through which air passes into the bellows 9, a float ventilator which prevents discharge of water in case of a defective tube or bellows 9.

The system according to the invention naturally includes a security valve 11.

Inside the expansion tank 1 floats for indicating the water level can be provided as well as a vacuum meter. No further attention is given to these additional appliances, since they represent devices known in the field.

Figure 2:
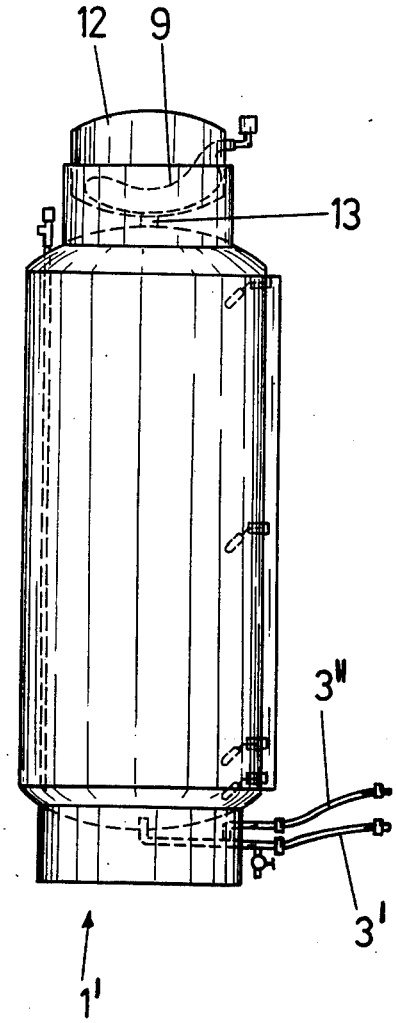
FIG. 2 is a schematic diagram of a further embodiment of an expansion tank according to the invention.

FIG. 2 shows an embodiment of an expansion tank 1' according to the invention, whereby the bellows 9' is not directly placed in the expansion tank 1', but within an additional tank 12 which is connected to the expansion tank 1' through a pipe 13.

Although the bellows 9' is not in the expansion tank 1 in this embodiment, it is still within an area subject to the pressure thereof, so that its function remains totally the same.

It shall also be mentioned that the invention is by no means limited to the above switching values (0.2 atm), but that such values can be chosen according to the actual requirements.

I claim:

1. A pressure balancing device for use in a heating system employing therein a heating medium, said device comprising:

an expansion tank adapted to be connected to said heating system and having separate feed and drain pipe means connected thereto for respectively feeding said heating medium to said expansion tank from said heating system and draining said heating medium from said expansion tank to said heating system;

said expansion tank having therein first chamber means, fluid isolated from the exterior atmosphere, for storage of said heating medium received from said heating system, said first chamber means being maintained at a pressure lower than that of said heating system;

second chamber means, having an interior in communication with the exterior atmosphere and an exterior exposed to the pressure in said first chamber means, for varying the volume of said first chamber means dependent upon the pressure therein;

valve means, positioned in said feed pipe means, for normally closing said feed pipe means and for opening said feed pipe means upon an increase in pressure in said heating system to thereby pass said heating medium from said heating system to said first chamber means; and pump means, positioned in said drain pipe means, for normally closing said drain pipe means and for opening said drain pipe means upon a decrease in pressure in said heating system to thereby pump said heating medium from said first chamber means to said heating system.

2. A device as claimed in claim 1, further comprising a second tank fluid connected to said first chamber means of said expansion tank and isolated from the exterior atmosphere; and wherein said second chamber means is positioned within said second tank.

3. A device as claimed in claim 1, wherein said second chamber means is formed by an expansible bellows.

4. A device as claimed in claim 3, wherein said bellows is an accordion-shaped bellows.

5. A device as claimed in claim 1, wherein said second chamber means is within said expansion tank and is formed by and separated from said first chamber means by a flexible diaphragm.

* * * * *